United States Patent [19]

Kayser et al.

[11] 4,261,084

[45] Apr. 14, 1981

[54] DEVICE FOR CRIMPING SYNTHETIC PLASTIC FIBERS

[75] Inventors: Hans-Dieter Kayser; Willi Kretzschmar, both of Neumünster, Fed. Rep. of Germany

[73] Assignee: Neumuenstersche Maschinen und Apparatebau Gesellschaft mbH., Neumünster, Fed. Rep. of Germany

[21] Appl. No.: 7,407

[22] Filed: Jan. 29, 1979

Related U.S. Application Data

[62] Division of Ser. No. 901,291, May 1, 1978.

[30] Foreign Application Priority Data

May 17, 1977 [DE] Fed. Rep. of Germany ..... 2722257

[51] Int. Cl.[3] ..... D02G 1/12

[52] U.S. Cl. ..... 28/255

[58] Field of Search ..... 28/255, 256, 257, 271, 28/272

[56] References Cited

U.S. PATENT DOCUMENTS

| | | | |
|---|---|---|---|
| 3,261,071 | 7/1966 | Clendening, Jr. et al. | 28/271 X |
| 3,324,526 | 6/1967 | Burns et al. | 28/271 |
| 3,373,470 | 3/1968 | Joly | 28/255 |
| 3,421,194 | 1/1969 | Breen et al. | 28/271 |
| 3,423,809 | 1/1969 | Schmitt | 28/271 X |
| 3,583,048 | 6/1971 | Gutmann, Jr. | 28/271 |
| 3,822,449 | 7/1974 | Dick | 28/272 |
| 3,824,656 | 7/1974 | Bauch | 28/255 |
| 3,827,113 | 8/1974 | Vidal et al. | 28/255 |
| 3,852,857 | 12/1974 | Ethridge et al. | 28/255 |
| 3,895,420 | 7/1975 | Strutz et al. | 28/255 |
| 3,936,916 | 2/1976 | Borenstein et al. | 28/255 |
| 4,014,084 | 3/1977 | Bauer et al. | 28/255 |
| 4,100,659 | 7/1978 | Bauer et al. | 28/255 |
| 4,120,078 | 10/1978 | Martin et al. | 28/255 X |

*Primary Examiner*—Robert Mackey

*Attorney, Agent, or Firm*—Michael J. Striker

[57] ABSTRACT

A plurality of separate synthetic plastic fibers are advanced through respective discrete guide passages of a housing towards a crimping chamber. The housing is provided with bores for supplying a stream of hot gas into each of the passages to thereby plasticize the fibers. Thereafter, the fibers pass into the crimping chamber, where the gas entering this chamber is withdrawn, so as to crimp the fibers. The housing is provided with another passage, which connects the opposite end of the crimping chamber with the exterior of the housing. This passage receives the fibers in crimped condition and allows them to be wound onto takeup spools individually.

3 Claims, 4 Drawing Figures

FIG. 2
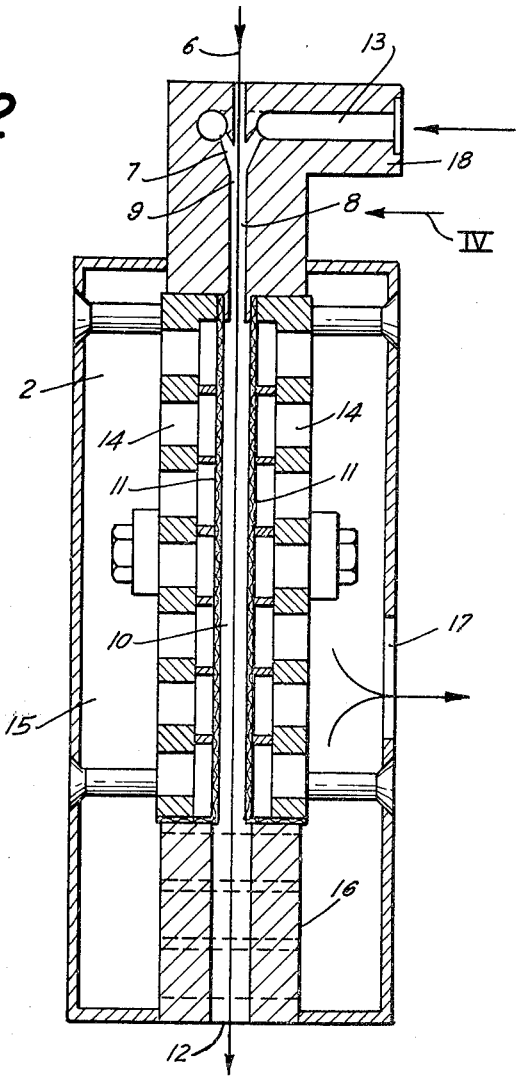
FIG. 4
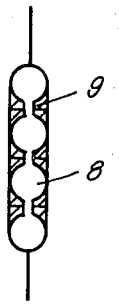
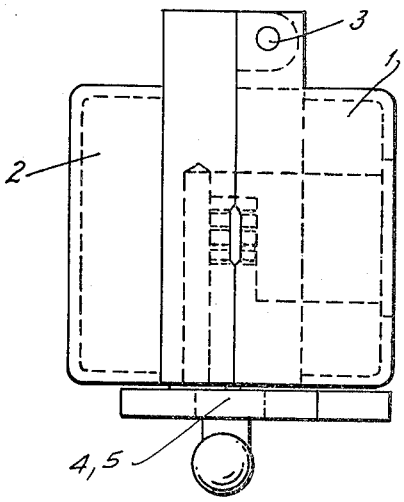
FIG. 3

DEVICE FOR CRIMPING SYNTHETIC PLASTIC FIBERS

CROSS-REFERENCES TO RELATED APPLICATIONS

This application is a divisional application of a parent application by the same inventors having Ser. No. 901,291 and a filing date of May 1, 1978.

BACKGROUND OF THE INVENTION

The present invention relates to a method and a device for crimping synthetic plastic fibers.

More particularly, this invention concerns a method and a device for the simultaneous crimping of a plurality of synthetic plastic fibers.

It is known in the art to entrain synthetic plastic fibers with a stream of hot gas to plasticize the fibers and then to admit such plasticized fibers into a crimping chamber, where the fibers are crimped.

It has been recognized that productivity of such a device is considerably limited by the holding capacity of the crimping chamber. It has also been noticed that the smaller the holding capacity of the crimping chamber, the more intensive the crimping action. But in the latter case only a limited number of fibers can be simultaneously crimped. One can increase the number of simultaneously crimped fibers by correspondingly increasing the holding capacity of the crimping chamber but this results in undesirably decreasing the crimping effectiveness of the device. Besides, it is then difficult to subsequently wind up the separated fibers in crimped condition.

In two known devices taught in U.S. Pat. No. 3,827,113 to Vidal et al and U.S. Pat. No. 3,895,420 to Strutz et al, attempts have been made to keep crimping quality high while crimping many fibers simultaneously. In both devices, the fibers are blown into a stuffing box after being crimped in the crimping chamber. The stuffed fibers are wadded together in the stuffing box and are withdrawn therefrom for subsequent winding on separate takeup spools.

These devices, while successfully achieving their original objectives, introduce new problems. Firstly, it is practically impossible, when the speed of operation is in excess of 1000 m/min, to properly insert the fibers into the device and to start the operation. Such insertion can be accomplished only when the feed spools are stopped. Secondly, the interior of the crimping chamber will always be filled with the fibers, so that each fiber has many points of contact with adjacent fibers, and the fibers may become entangled with one another.

Thirdly, the air outlets from the stuffing box must be carefully manufactured to avoid sharp edges. These edges can cause breaking and clogging of the fibers, and thereby interfere with smooth operation of the takeup spools.

SUMMARY OF THE INVENTION

It is a general object of the present invention to avoid the disadvantages of the prior art.

More particularly, it is an object of the present invention to provide such a device which can continuously and simultaneously crimp a plurality of fibers of different denier moving at a speed of up to 4000 meters/minute.

Another object of the present invention is to provide a device which eliminates troubles at the takeup spools which hold the crimped fibers.

In pursuance of these objects and others which will become apparent hereafter, one feature of the present invention resides in entraining a plurality of separate, parallel synthetic plastic fibers through discrete guide passages towards a crimping chamber by the use of a heated gas which simultaneously guides and plasticizes the fibers. The hot gas is applied at an acute angle to each fiber in its respective guide passage, and conducts the fibers into the crimping chamber.

The device is formed by two portions which are hinged together. The device may be opened to allow initial insertion of the fibers and closed during subsequent operations.

Further, no stuffing bar is needed and the fibers pass through the device without touching non-adjacent fibers.

The foldable (i.e. openable) construction of the device renders the guide passages for the fibers readily accessible and avoids the need for structural components which could otherwise hinder the insertion of fibers. Thus, conventional arrangements for injecting the fibers into the passages can be used to insert the fibers at full operating speed. Inasmuch as the fibers are advanced parallel to each other and the hot gas is applied separately at opposite sides of each fiber, each of the fibers is seldom in contact with its immediate neighbors during its travel in the crimping chamber. Therefore, the fibers do not become tangled and can be wound separately on the takeup spools without further difficulty.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWINGS

FIG. 2 is a side view of the invention in a closed position;

FIG. 3 is a top view of the invention in a closed position; and

FIG. 4 is a diagrammatic sectional view taken in the plane of the arrow IV in FIG. 2 and showing a portion of the invention, namely the guide passage.

DESCRIPTION OF PREFERRED EMBODIMENTS

Figure 1:
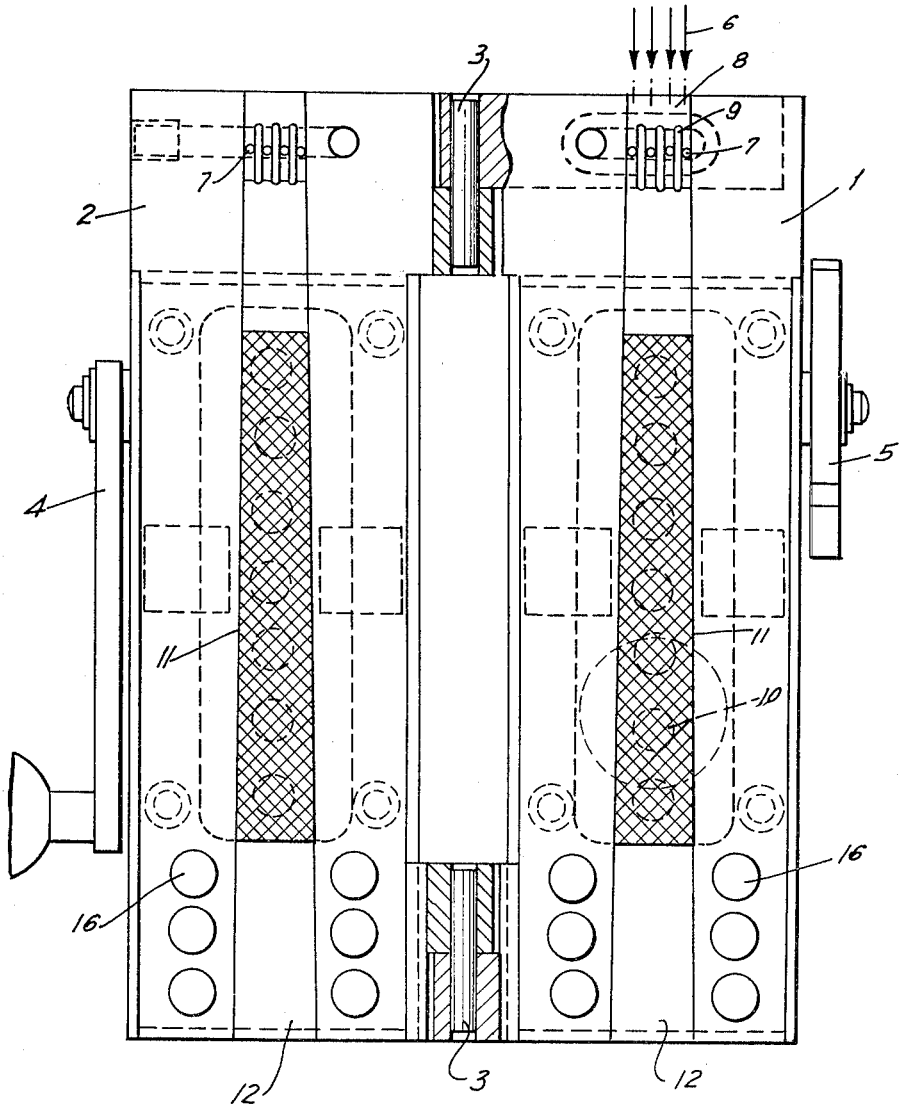
FIG. 1 is a plan view of the present invention in an open position.

Referring now to the drawings and first to FIG. 1 thereof, it may be seen that the reference numerals 1 and 2 designate two halves which together constitute the foldable housing of the crimping device. The halves 1 and 2 are foldable on two hinge pins 3. When these halves 1 and 2 are moved to a closed position in which they together define a housing, they are locked in such position by fastening elements 4 and 5.

The housing, when folded and locked, has a crimping chamber 10 which is best seen in FIG. 2. At one end of the chamber 10four parallel elongated guide passages 8 are located between partitions 9. The partitions are sufficiently short that when the halves are closed, they do not form walls that completely separate the guide passages, as is shown in FIG. 4. At the end of the chamber 10 remote from the passages is located an open-ended outlet conduit 12, which leads to the outside.

Each of the guide passages 8 can receive a separate synthetic plastic fiber 6 and guide it towards the crimping chamber 10. The passageway 12 allows the fibers to be withdrawn from the chamber after crimping.

The housing is further provided with four pairs of jets 7, each pair communicating with opposed sides of a corresponding guide passage 8. The jets 7 feed a stream of hot gas into the passageways 8 for plasticizing the synthetic plastic fibers. Moreover, the jets 7 are so arranged as to supply the hot gas at an acute angle to opposite sides of each of the synthetic plastic fibers 6, thereby entraining the fibers into the chamber 10. The guide passages 8 communicate with each other via gaps between partitions 9.

The synthetic plastic fibers 6 are crimped in the crimping chamber 10. The hot gas which enters the crimping chamber 10 together with the plasticized synthetic plastic fibers is withdrawn from the crimping chamber 10 through a perforated wall 11 of the chamber 10. The perforated wall 11 is interchangeable.

After the fibers 6 are cooled, they are advanced in crimped condition to takeup spools (not shown) to be wound thereon separately.

As shown in FIG. 2, the stream of hot gas is introduced into a bore 13 which is provided in an enlarged portion 18 of the wall of the guide passages 8. The hot gas is further introduced through the jets 7, which are arranged at an acute angle to the passageways 8 so as to impinge in each guide passage 8 separately onto the fiber 6 therein.

After passing through perforated wall 11, the hot gas is withdrawn through perforations 14 into side recesses 15 which are provided in the housing for collecting the gas which is withdrawn from the crimping chamber. In the area where the fibers 6 leave the chamber 10, these side recesses are connected with one another by throughgoing holes in the wall of the outlet conduit 12.

The gas collected in the recesses 15 is withdrawn from the housing by drawing the gas through an opening 17 which connects the exterior of the housing with the interior thereof.

The crimping chamber 10 has a conical cross-section diverging in the direction of movement of the synthetic plastic fibers 6 through the chamber 10.

It will be understood that each of the elements described above, or two or more together, may also find a useful application in other types of devices for crimping synthetic plastic fibers, differing from the types described above.

While the invention has been illustrated and described as embodied in a device for crimping synthetic plastic fibers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A crimping device for simultaneously crimping a plurality of synthetic plastic fibers and the like, comprising a housing having a plurality of coplanar downwardly extending guide passages which allow the fibers to be simultaneously introduced into the housing and a unitary outlet conduit which allows each of the crimped fibers to be withdrawn from the housing onto a separate takeup spool, the housing having a plurality of jets communicating with the guide passages at an acute angle which extends forwardly into the housing, whereby hot gas introduced into the guide passages through the jets will simultaneously entrain and plasticize the fibers and will prevent the fibers from touching the passages, the housing further having a hollow elongated crimping chamber extending between the forwardmost ends of the passages and the outlet conduit in which crimping chamber crimping of the fibers can occur, the chamber being vented to the outside to allow the gas which enters the chamber through the passages to be withdrawn from the chamber and to thereby cause crimping of the fibers to occur, the housing being split into two pieces along the plane occupied by the passages and the pieces being hingedly secured together and each including a perforated wall which is interchangeably connected to the piece and forms an internal surface of the crimping chamber when the housing is closed, the passages, chamber and outlet conduit being so aligned that the fibers, when passing forwardly through the device trace out flow paths which pass forwardly through the device from the passages, through the chamber and out of the outlet conduit in a generally parallel fashion; and means for detachably securing the two pieces of the housing together.

2. The device defined in claim 1 wherein the chamber widens transversely as it extends forwardly from the passages to the conduit.

3. The device defined in claim 1 wherein the passages, chamber and outlet conduit are so arranged that only the fibers passing through neighboring passages touch each other within the crimping chamber.

* * * * *